United States Patent [19]

Kajii et al.

[11] Patent Number: 4,651,013

[45] Date of Patent: Mar. 17, 1987

[54] SMOKE DETECTOR WITH CHANGEABLE PULSE LIGHT EMITTING INTERVAL FOR MONITORING PURPOSES

[75] Inventors: Shigeru Kajii, Machida; Hiroshi Honma, Hino; Junichi Narumiya, Fujisawa, all of Japan

[73] Assignee: Hochiki Corporation, Tokyo, Japan

[21] Appl. No.: 703,328

[22] Filed: Feb. 20, 1985

[30] Foreign Application Priority Data

Feb. 28, 1984 [JP] Japan ..... 59-27719[U]

[51] Int. Cl.[4] ..... G08B 17/10

[52] U.S. Cl. ..... 250/573; 250/565; 340/630

[58] Field of Search ..... 250/573, 574, 575, 564, 250/565; 356/437, 438, 439; 340/577, 578, 628, 630

[56] References Cited

U.S. PATENT DOCUMENTS 4,163,969 8/1979 Enemark ..... 250/574

4,198,627 4/1980 Kakigi ..... 250/574

4,528,555 7/1985 Yasukawa et al. ..... 250/573

*Primary Examiner*—Edward P. Westin

*Attorney, Agent, or Firm*—Lackenbach Siegel Marzullo & Aronson

[57] ABSTRACT

A smoke detector comprising a light emitting section from which pulse light is radiated to a detection area with a predetermined period and a light receiving section which is disposed so as to be opposite to the light emitting section to receive the light for detecting a change caused in the detection area in the form of a change in photo-output level. The light receiving section has a monitor terminal for outputting a monitor signal corresponding to the photo-output level. When a measuring apparatus is externally connected to the monitor terminal, the supervision period is shortened as compared with the normal supervision period, so as to enable the monitor signal to be supervised substantially in real time, thereby facilitating an adjusting operation.

6 Claims, 8 Drawing Figures

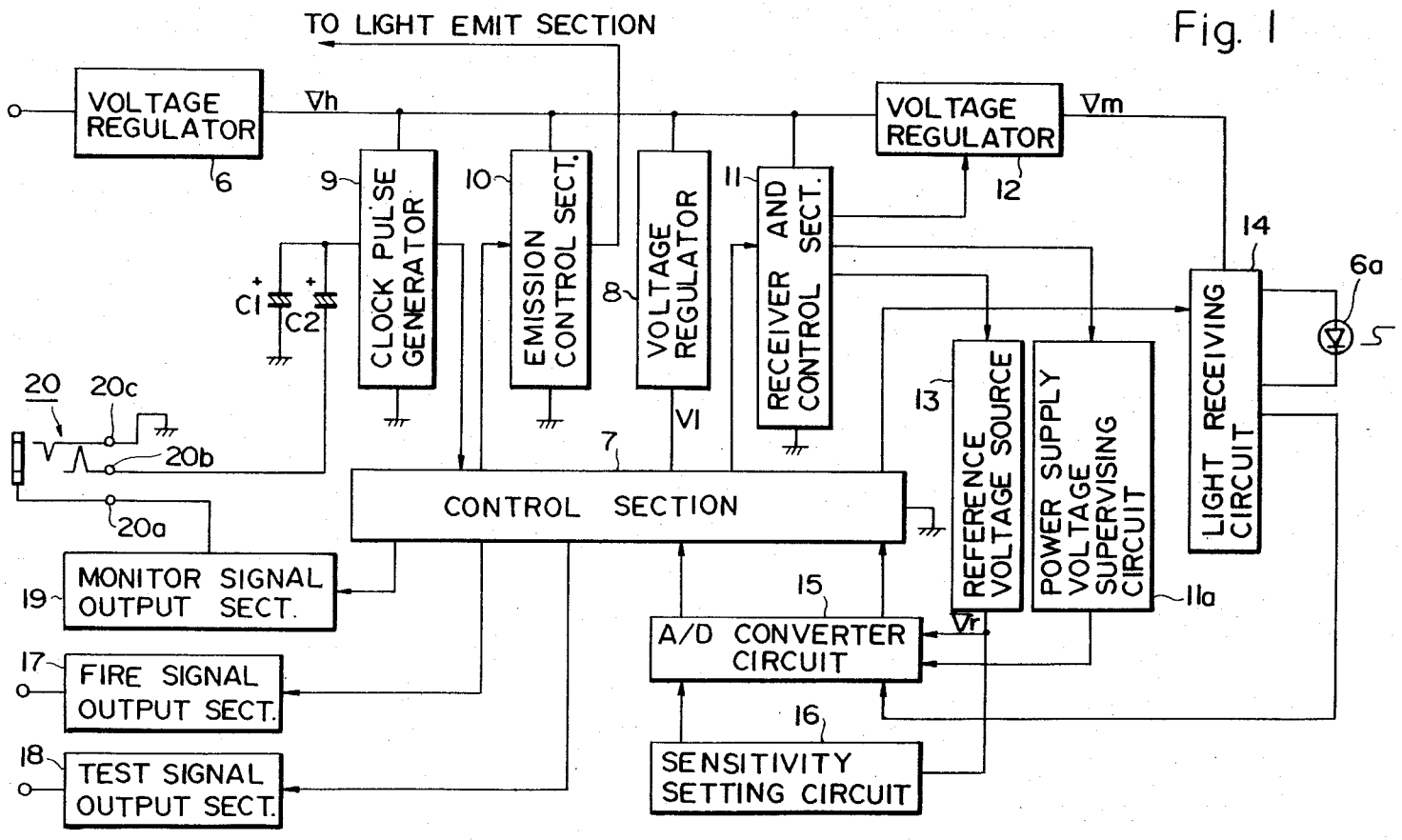
Fig. 1
VOLTAGE REGULATOR
12
Vm
LIGHT RECEIVING CIRCUIT
14
6a
5
POWER SUPPLY VOLTAGE SUPERVISING CIRCUIT
11a
REFERENCE VOLTAGE SOURCE
13
Vr
RECEIVER AND CONTROL SECT.
11
VOLTAGE REGULATOR
8
Vl
EMISSION CONTROL SECT.
10
CLOCK PULSE GENERATOR
9
TO LIGHT EMIT SECTION
Vh
VOLTAGE REGULATOR
6
C1
C2
CONTROL SECTION
7
A/D CONVERTER CIRCUIT
15
SENSITIVITY SETTING CIRCUIT
16
20
20a
20b
20c
MONITOR SIGNAL OUTPUT SECT.
19
FIRE SIGNAL OUTPUT SECT.
17
TEST SIGNAL OUTPUT SECT.
18

SMOKE DETECTOR WITH CHANGEABLE PULSE LIGHT EMITTING INTERVAL FOR MONITORING PURPOSES

BACKGROUND OF THE INVENTION

1. Field of the Invention

This invention relates to a smoke detector for detecting attenuation or interruption of intermittently emitted light pulses for detecting smoke generated by fire.

2. Prior Art

There is already known a separate-type smoke detector in which a light emitted section and a light receiving section are disposed opposite to each other and spaced at a given distance to define a detection area therebetween for detecting attenuation or interception of light pulses which is intermittently emitted from the light emitting section. The smoke detector is provided with a monitor terminal for producing a monitor signal corresponding to a photo-signal for the purpose of adjusting operation of the optic axis and the photo-output level when the detector is installed. For testing and adjusting, a measuring apparatus such as an ammeter is connected externally and adjustment is carried out by measuring the monitor signal.

In the smoke detector of this type, however, emission of light pulses is made, for example, at intervals of 3 seconds in order to save power consumption. Therefore, if the monitoring period is not changed for test and adjustment, there is caused a time delay corresponding to the monitoring period before a change appears in the output signal at the monitor terminal after the adjusting operation has been made. Thus, the conventional smoke detector of this type has the problem that it takes too much time to carry out the adjustment operation.

The conventional smoke detector also has another problem. When the light emitting section and the light receiving section of the smoke detector are set on the ceiling or the like, the adjustment of the optic axis between the light emitting section and the light receiving section is first made and thereafter the photo-output level adjustment is made to set the level of the photo-signal to a desired level under the condition when there is no smoke in the detection area. However, in the conventional smoke detector, the light receiving section and the light emitting section are supplied with power from a central signal station which is in operation while the adjustment operation is carried out. Consequently, if during adjustment the photo-detector of the light receiving section is inadvertently shut off, the level of the photo-signal falls below a threshold level and a false fire detection signal is transmitted to the central signal station. Since a plurality of smoke detectors are connected to the same line derived from the central signal station, and a fire signal is generated when the impedance of the signal line from the central signal station falls to a low value, the central station will be unable to receive a true fire detection signal if a smoke detector other than the detector under adjustment detects a fire. Or, the alarm system may be set off so as to prevent the central signal station from operating when a false fire detection signal is produced during the adjustment operation. In either case, normal supervisory operation cannot be maintained.

SUMMARY OF THE INVENTION

It is an object of the present invention to provide a smoke detector in which the pulse light emitting interval is shortened when a measuring apparatus is connected to a monitor terminal for carrying out a monitoring operation and which is capable of monitoring a monitor signal substantially in real time, thus facilitating the adjustment operation.

It is another object of the present invention to provide a smoke detector which can be tested and adjusted without interfering with the fire supervisory operation of other smoke detectors connected to the same line.

BRIEF DESCRIPTION OF THE DRAWINGS

FIG. 1 is a block diagram of a light receiving section of one form of a smoke detector according to the present invention;

DETAILED DESCRIPTION OF THE PREFERRED EMBODIMENTS

At the outset, an entire fire supervisory system employing smoke detectors of the present invention will be explained for better understanding of the invention.

Figure 7:
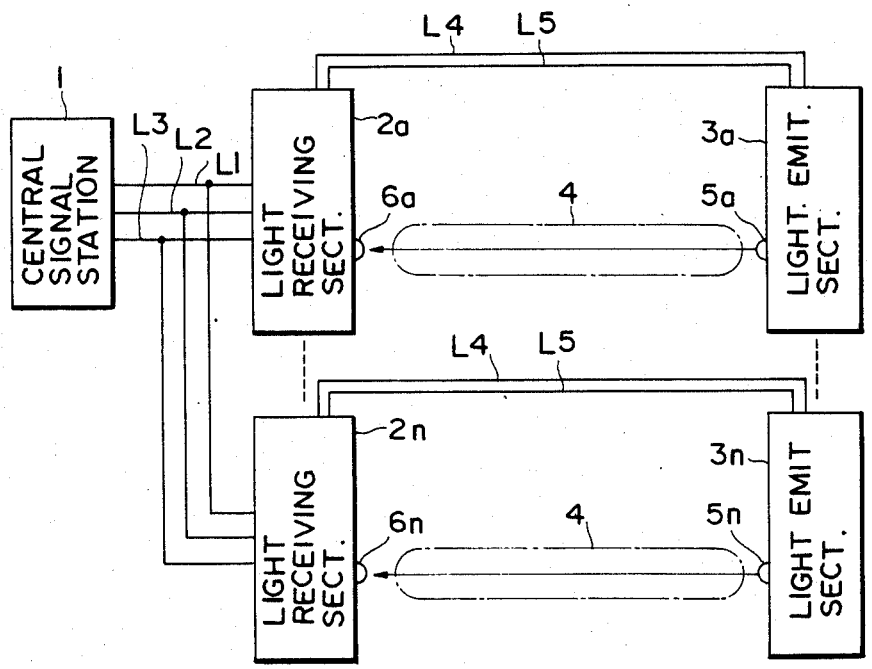
FIG. 7 is a block diagram illustrating an entire fire supervisory system employing the smoke detector of the present invention.

FIG. 7 illustrates a general arrangement of the system. A power/signal line L1, test signal line L2 and a common line L3 are derived from a central signal station 1 and a plurality of light receiving sections 2*a* to 2*n* are connected thereto in parallel with each other. Light emitting sections 3*a* to 3*n* are disposed at positions where they are opposite to the corresponding light receiving sections 2*a* to 2*n*, respectively, and separated, for example, by 15 meters from each other to define a smoke detection area 4 therebetween. The light emitting sections 3*a* to 3*n* are connected to the corresponding light receiving sections 2*a* to 2*n*, respectively, by signal lines L4 and L5 over which a light emission control signal is transmitted from the central signal station. The light emitting sections 3*a* to 3*n* have light emitting elements 5*a* to 5*n*, respectively, while the light receiving sections 2*a* to 2*n* have photodetectors 6*a* to 6*n*, respectively, so as to receive light transmitted through the smoke detection area 4.

The circuits of the light receiving sections and the light emitting sections will now be described generally. Each of the light receiving sections 2*a* to 2*n* sets and registers a reference value based on the photo-output level first obtained after completion of adjustment at the time of installation or after re-application of power, computes a threshold value based on the reference value and compares a received smoke detection signal with the threshold value whenever the smoke detection signal is supplied to make a fire determination. In addition, each of the light receiving sections has a monitor terminal as will be described in detail later. A monitor signal corresponding to a photo-signal output from the respective photodetector 6a to 6n is output at the monitor terminal so that the signal may be monitored by connecting a measuring means such as an ammeter to the monitor terminal.

The light emitting sections 3a to 3n are continuously supplied with power from the respective light receiving sections 2a to 2n through the signal lines L4 and L5. The supplied power is charged by a charging means such as a capacitor (not shown) and discharged to emit light according to the control by the light receiving section 2a to 2n. Since the light emission of the respective light emitting section 3a to 3n consumes a large amount of current, the light emission is made momentarily for a time as short as, for example, 20 sec. A known means such as an infrared light emitting diode (LED) may be used as the light emitting means.

Figure 2:
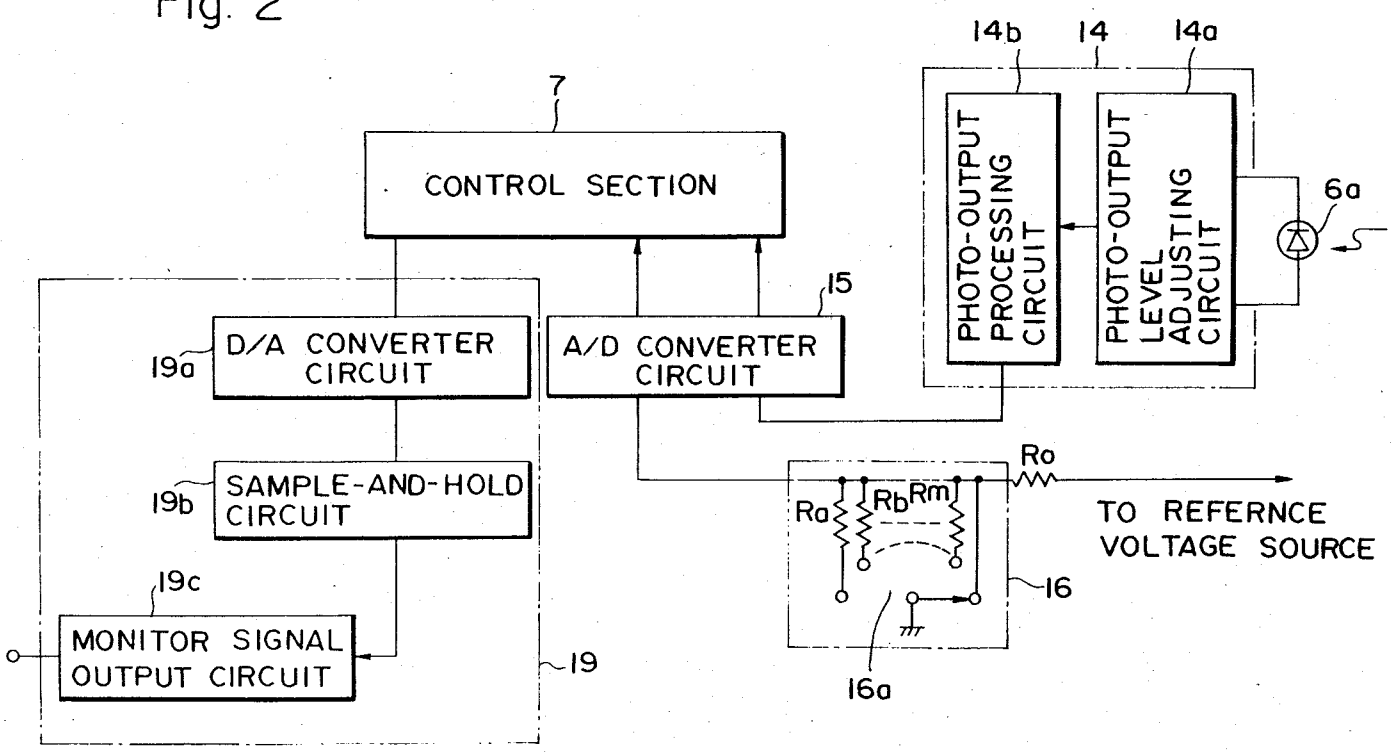
FIG. 2 is a block diagram illustrating in detail the principal portion of FIG. 1.

Referring now to FIGS. 1 and 2, there is illustrated in detail the light receiving section 2.

A voltage regulator circuit 6 is supplied with power from the central signal station 1 and provides a power source voltage Vh of, for example, 15 V. A control section 7 comprises a microcomputer and it is operational by a power source voltage V1 of, for example, 5 V from a voltage regulator circuit 8 to provide light emission control of the light emitting section, fire determination based on the photo-signal at the light receiving section, computation of the threshold value for the fire determination based on the set sensitivity, and control processing for the output of a fire signal, the output of a test signal when there is some abnormality with the power supply, or the output of the monitor signal.

A clock oscillator 9 generates a clock pulse by which the control section 7 carries out various control processing operations. The clock oscillator 9 may be a PUT (Programmable Unijunction Transistor) oscillation circuit and it oscillates to generate a clock pulse with an oscillation period T1 corresponding to a time constant determined by a synthetic capacitance (C1+C2) of capacitors C1 and C2 which are connected externally. The oscillation period T1 of the clock pulse is set generally as 3 sec in a steady-state supervisory condition.

Numeral 10 designates a light emission control section for controlling the operation of the light emitting section 3. The control of the light emission control section 10 is effected by an output from the control section 7 based upon the clock pulse from the clock pulse oscillator 9. Numeral 11 is a receiver and control section which produces a control signal every supervisory period T1 in response to the output from the control section 7, based upon the clock pulse, to a voltage regulator circuit 12 and a reference voltage source 13. The voltage regulator circuit 12 supplies a power source voltage Vm of, for example, 10 V to a light receiving circuit 14 in response to the control signal. Numeral 11a is a power source voltage supervising circuit which is input with the output voltage from the receiver and control section 11 to supervise sag of the power source voltage Vh. It also detects cutoff of power supply from the central signal station 1 and supervises rising of the power source voltage due to the resumption of power supply and it transmits supervisory data to the control section 7 through an A/D converter circuit 15.

The light receiving circuit 14 includes a photodetector 6a for receiving light pulses from the light emitting section 3. the light receiving circuit 14 samples a photo-signal of the photodetector 6a at a predetermined timing based on a light receiving control signal from the control section 7 and produces a peak value as the photo-signal. More specifically, the light receiving circuit 14 comprises a photo-output level adjusting circuit 14a and a photo-signal processing circuit 14b. In the photo-signal processing circuit 4b, known means for adjusting and processing electrical output values, such as an amplifier, a filter, a peak-hold circuit or the like (not shown) are employed. The photo-output level adjusting circuit 14a comprises, for example, a variable resistor connected to the photodetector 6a so as to adjust an electrical signal corresponding to the photo-output from the photodetector 6a to an appropriate level. Other means may alternatively be used in the photo-output level adjusting circuit 14a.

A reference voltage Vr, e.g., 2.5 V, from the reference voltage source 13 is supplied as input to the A/D converter circuit 15 as a reference voltage for the A/D conversion. The A/D converter circuit 15 then converts the photo-signal from the light receiving circuit 14 into a digital signal and inputs the same to the control section 7. The A/D converter circuit 15 also converts a sensitivity setting signal provided by the sensitivity setting circuit 16 into a digital signal and inputs it to the control section 7.

The sensitivity setting circuit 16 divides the reference voltage Vr supplied from the reference voltage source 13, according to the switch positions of a rotary switch so as to set the sensitivities for computing the threshold values, for example, fire determination of seven stages. More specifically, the reference voltage Vr from the reference voltage source 13 is supplied to the sensitivity setting circuit 16 through a resistor Ro. Resistors Ra, Rb . . . Rn of different resistances are selectively connected to a line leading to the resistor Ro through the rotary switch 16a. The reference voltage Vr is divided by the resistor Ra, Rb the rotary switch 16a and the resistor Ro. The divided voltage is provided to the A/D converting circuit 15 to set the detection sensitivity for the supervision, according to the distance between the light emitting section 2 and the light receiving section 3 etc. The rotary switch 16a has another adjustment position connected to a short-circuit line. When the adjustment position is selected and the connection line leading to the resistor Ro is grounded, the adjusting function of the sensitivity setting circuit 16 is not effected.

The signals from the control section 7 are applied to the fire signal output section 17, the test signal output section 18 and the monitor signal output section 19. The fire signal output section 17 makes the power/signal line L1 derived from the central signal station 1 and the common line L3 to be short-circuited to a low impedance in response to a fire detection signal from the control section 7 and transmits the fire detection signal to the central signal station 1. The test signal output section 18 produces a test signal to the central signal station when the control section 7 recognizes a sag in the power source voltage, or an abnormality in the reference value based on the photo-signal registered as a reference value for a fire determination when the installation of the detector has been completed or power is re-applied.

The monitor signal output section 19 has a function of again converting the digital signal corresponding to the photo-signal of the light receiving circuit 14 which is the input to the control section 7 from the A/D converter circuit 15 into an analog signal and maintaining same. More specifically, the monitor signal output section 19 includes a D/A converter circuit 19*a*, a sample-and-hold circuit 19*b* and a monitor signal output circuit 9*c*. The data input to the control section 7 from the A/D converter circuit 15 is supplied to the D/A converter circuit 19*a* concurrently with other processing operation and the D/A converter circuit 19*a* produces an analog signal corresponding to the data to the sample-and-hold circuit 19*b* so as to be sampled-and-held by the circuit 19*b*. The monitor signal is supplied to the monitor signal output section 19 from the control section 7 every supervisory period corresponding to the clock pulses from the clock oscillator 9 and the signal is held for the period. The actual supervisory period is such that, for example, the light emitting period of the light emitting section 3 and the output period of the light receiving section 2 are set at 3 sec so as to correspond to the period T1 of the clock pulses and three photo-outputs are sequentially subjected to moving averaging to produce a monitor signal every 3 sec. Various noises are eliminated by the moving avaraging operation. However, for simplifying the explanation, the light emitting period of the light emitting section 3, the output period of the light receiving section 2 and the supervisory period are assumed to be set to the period T1 of the clock pulses, respectively.

Figure 2A:
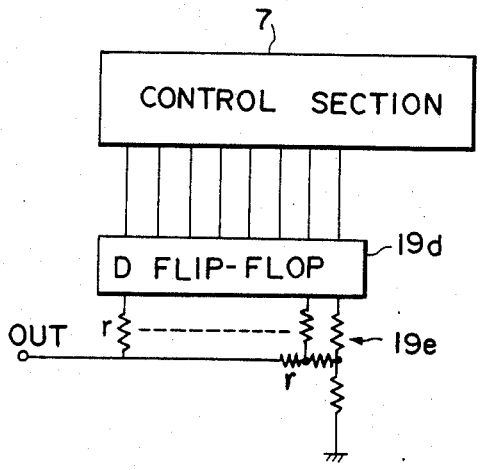
FIG. 2*a* is a block diagram of another form of a monitor signal output section.

Another arrangement of the monitor signal output section 19 is as illustrated in FIG. 2*a*. More specifically, the arrangement includes a D flip-flop circuit of 8 bits as a sample-and-hold circuit and a resistive ladder network 19*e* as a D/A converter circuit. The resistive ladder network 19*e* has resistors r corresponding to the bits of the D flip-flop circuit 19*d*. The D flip-flop circuit 19*d* is first provided with a control signal and a data signal of 8 bits from the control section 7 so that the data signal is read at the rising of the control signal. The output from the D flip-flop circuit 19*d* is held until the data read by the control signal is cleared and converted into an analog amount by the resistive ladder network 19*e*. For this reason, a D/A converter which is complicated in circuit structure can be omitted. The number of bits of the D flip-flop is not limited to the example as illustrated, so long as it corresponds to the number of bits of the data signal.

The light receiving section 2 further comprises a jack 20 as a monitor terminal. When a measuring apparatus is connected to the jack 20, the monitor signal which is sampled-and-held by the monitor signal output circuit 19*c* is measured in a current mode. The sample-and-hold circuit 19*b* holds a given output value until a succeeding photo-signal is provided from the control section through the D/A converter circuit 19*a*.

The jack 20 has a jack terminal 20*a* which is connected to the monitor signal output section 19 and has another jack terminal 20*b* which is connected to a negative side of the capacitor C2 which is in turn connected externally to the clock oscillator 9. A further jack terminal 20*c* of the jack 20 is grounded. In the position as illustrated wherein no measuring apparatus such as an ammeter is connected to the jack 20, the terminals 20*b* and 20*c* are connected, so that the capacitor C2 of the clock oscillator 9 is grounded and the oscillation period of the clock oscillator 9 is determined by the synthetic capacitance (C1+C2) of the capacitors C1 and C2. When a measuring apparatus such as an ammeter is connected to the jack 20, the jack terminals 20*b* and 20*c* are separated from each other, so that the function of the capacitor C2 of the clock oscillator 9 is lost. As a result, the oscillation period is changed to an oscillation period which is determined by the capacitance of the capacitor C1, and the capacitance of the capacitor for determining the oscillation period is reduced. Therefore, the oscillation period of the clock pulses is shortened. For example, if C1=C2, the oscillation period of the clock pulses is reduced to half.

Figure 3:
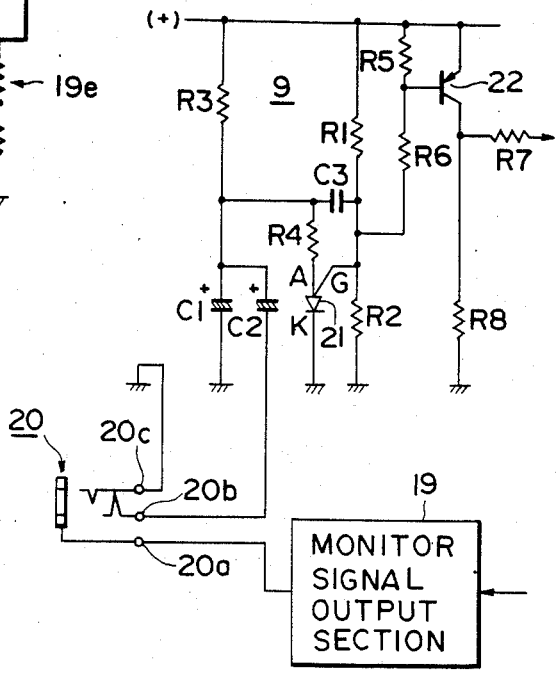
FIG. 3 is a circuit diagram of one example of a clock pulse generator of FIG. 1.
Figure 5:
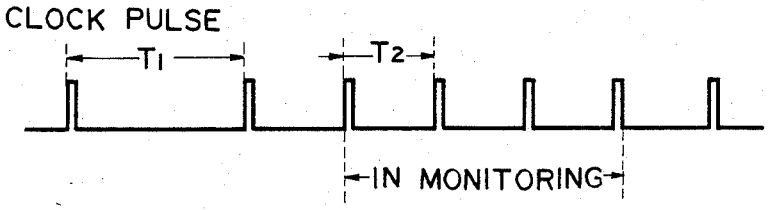
FIG. 5 is a time chart showing clock pulse periods in relation with the monitoring.

FIG. 3 is a circuit diagram of an arrangement of the clock oscillator 9 of FIG. 1. A reference voltage determined by division by resistors R1 and R2 is set at a gate G of PUT 21. An anode A of PUT 21 is connected to a junction of a resistor R3 and a parallel circuit of the capacitors C1 and C2 through a load resistor R4. The gate G is connected to an output circuit comprising resistors R5 to R8 and a transistor 22. The capacitor C2 is grounded through the jack terminals 20*b* and 20*c* of the jack 20 and the jack terminal 20*a* is connected to the monitor signal output section 19 as described above.

The operation of the clock oscillator 9 employing PUT 21 as illustrated in FIG. 3 is as follows. When no measuring apparatus is connected to the jack 20, the capacitors C1 and C2 are charged in parallel with each other at a time constant which is determined by the resistor R3 and the synthetic capacitance of the capacitors C1 and C2. When the terminal voltage of the capacitors C1 and C2 exceeds a gate voltage of PUT 21 by a predetermined level, PUT 21 is rendered conductive and the transistor 22 is turned on to produce clock pulses through the resistor R7.

When a measuring apparatus is connected to the jack 20, the capacitor C2 is disconnected and the anode voltage of PUT 21 is raised at a time constant determined by the resistor R3 and the capacitor C1. Since the time constant becomes smaller, the period of oscillation upon conducting of PUT 21 is shortened.

The entire operation of the present embodiment will now be described with reference to the flowchart of FIG. 4.

When the light receiving sections 2*a* to 2*n* and the light emitting sections 3*a* to 3*n* are installed, an optic axis adjustment is made between the light emitting elements 5*a* to 5*n* and the photodetectors 6*a* to 6*n*, respectively, and the photo-output level adjustment is made for light receiving sections 2*a* to 2*n*.

In the adjustment, the rotary switch of the sensitivity setting circuit 16 may be switched to the adjustment position to deenergize the circuit 16 so that the control section 7 may recognize that the fire detector is under adjustment.

Figure 4:
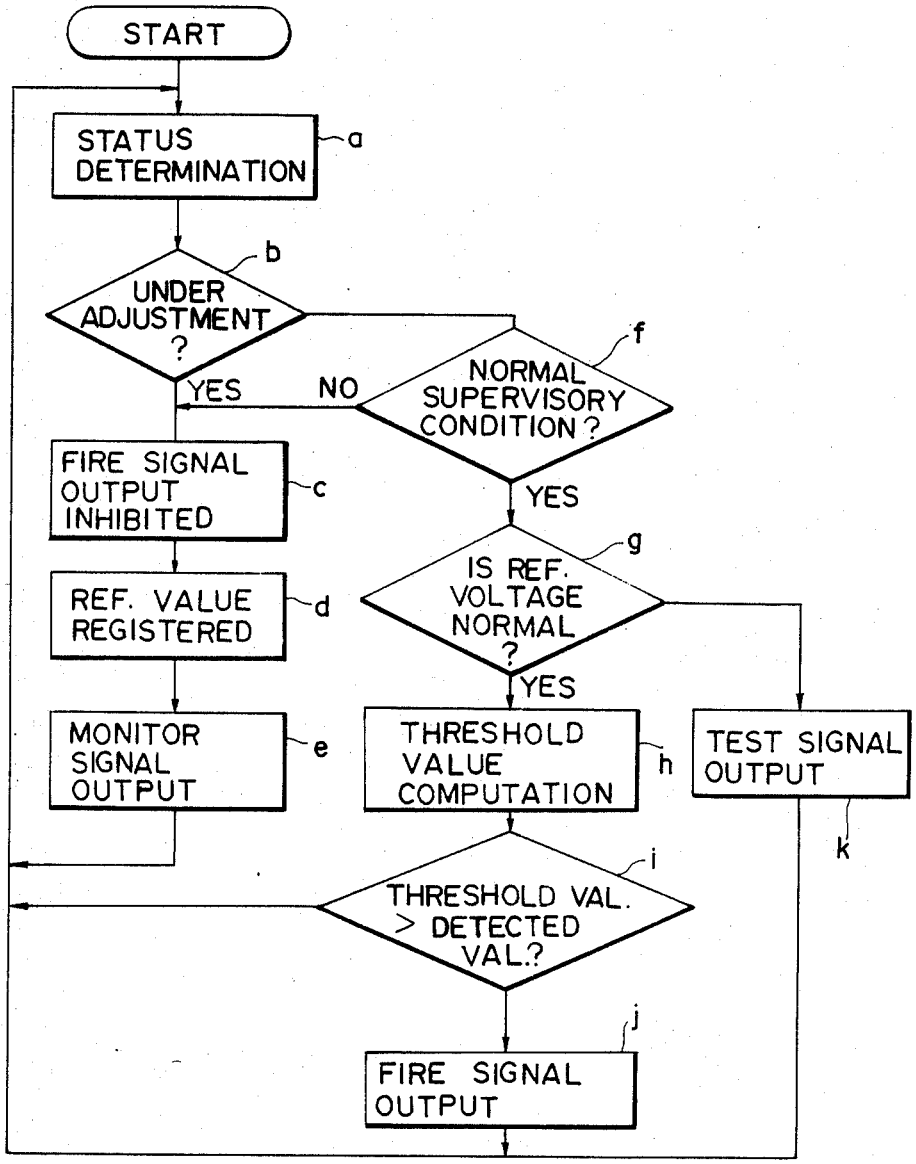
FIG. 4 is a flowchart showing a control process at the light receiving section of FIG. 1.

In FIG. 4, status determination is made at block a if the detector is under adjustment or under supervision. Since the rotary switch is at the adjustment position at the time of adjustment after installation of the detector, it is determined at block b that the detector is under adjustment. When the adjustment status is determined at block b, the program proceeds to block c to halt fire determination and inhibit the fire signal transmission from the fire signal transmitting section 21.

The program is further advanced to block d where a photo-signal obtained upon receipt of light pulses from the light emitting section is registered as a reference value for computing a threshold value for the fire determination. Then, at block e, a momentary photo-signal is produce as a monitor signal to the jack 20 from the monitor signal output section 19. The processing operations of blocks a to e are repeated until the adjustment after installation of the detector has been completed and the rotary switch has been switched to a desired sensitivity setting position. The processing cycle has a period corresponding to the clock period T1 of the clock oscillator 9 which is determined by the synthetic capacitance of the capacitors C1 and C2 when a measuring apparatus is not connected to the jack 20.

Therefore, the adjustment operator can make optic axis adjustment between the light emitting section 3 and the light receiving section 2 the photo-output level adjustment, while confirming the adjustment by the monitor signal, without having any apprehension of erroneous transmission of a fire signal during the adjustment operation. When the rotary switch 16*a* built in the sensitivity setting circuit 16 is operated, after completion of the adjustment, to select a desired detection sensitivity, for example a sensitivity of 50%, it is determined at block b that the detector is not under adjustment and the program proceeds to block f.

At block f, it is determined if the supervisory voltage is normal. More specifically, the power supply voltage supervising circuit 11*a* supervises a change in the power supply voltage. The determination as to whether the power supply voltage is normal or not is made on the basis of the supervision data. If the power supply voltage is low or sagged and it is determined that the voltage is not the normal supervisory voltage, the program proceeds to block c to inhibit the production of a fire signal as described above. On the other hand, if the power supply voltage is determined as normal, the program proceeds to block g. At block g, it is determined if the reference value registered at block d is normal or not. If the reference value is determined to be not normal due to possible misadjustment etc., the program proceeds to block k to generate a test signal from the test signal output section. If the reference value is determined to be normal, the program proceeds from block g to block h. At block h, the value of the set sensitivity of 50% is multiplied by the reference value registered at block d to compute a threshold value. At block i, the computed threshold value is compared with a detection signal from the light receiving circuit 14 to make the fire determination. When the light reduction is small, i.e., when the detection signal is larger than the threshold value, it is determined as normal and the program is returned to block a to continue the supervisory operation. When the light reduction becomes large due to the penetration of smoke into the detection area and the detection signal becomes smaller than the threshold value, it is determined to be a fire and the program proceeds to block j where the fire signal output section 17 is actuated to direct the transmission of a fire signal.

When a measuring apparatus such as an ammeter is connected to the jack 20 of the light receiving section at a time of adjustment, the capacitor C2 of the clock oscillator 9 is disconnected and the clock period T1 is changed to a shorter clock period T2 which is determined by the capacitor C1 during a time when the measuring apparatus is connected to the jack 20. Thus, the light emitting element of the light emitting section 2 emits light with a clock period T2. More specifically, during the monitoring, the monitor signal is produced at block e with a supervisory period T2 which is shorter than the ordinary supervisory period T2. Therefore, the monitor signal which represents a result of the optic axis adjustment or photo-output level adjustment can be watched with a real time. Since the results of the adjustment immediately appear in the form of the monitor signal, adequate adjusting operation can be effected without considering a time delay of the monitor signal. In addition, since the supervisory period for providing monitor signal is automatically shortened only by connecting the measuring apparatus to the jack 20, the operator can perform the adjusting operation without paying any attention to the change of the supervisory periods.

The clock periods T1 and T2 may be determined as desired. In the embodiment as illustrated, The period T2 is half of the period T1. However, if the period T2 is too short, there is a serious fluctuation in data by disturbances due to the fluctuation in the density of air in the detection area. Therefore, an optimum value should be determined empirically.

Figure 6:
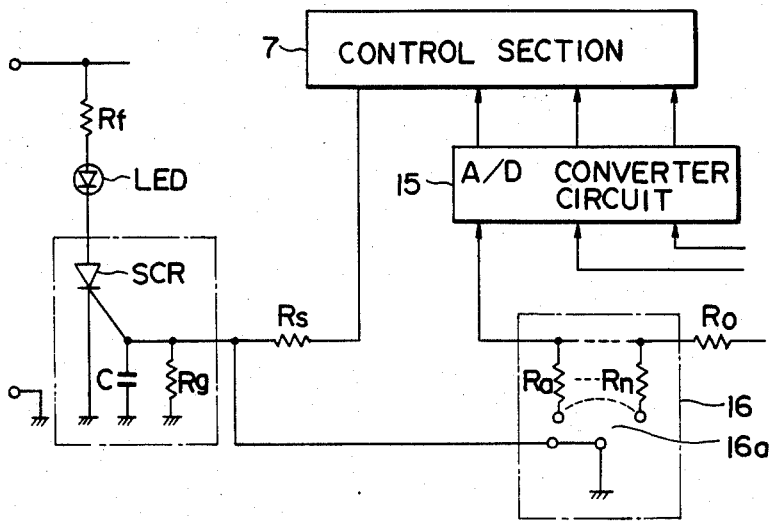
FIG. 6 is a circuit diagram of another example of means for inhibiting the output of a detection signal which is provided in the light receiving section.

FIG. 6 is a circuit diagram of a principal portion of another embodiment of the present invention. In this embodiment, when the rotary switch 16*a* built in the sensitivity setting circuit 16 as shown in FIG. 2 is set to the adjustment position, the potential of the gate side of the thyristor SCR is lowered to ground level to stop the detection operation of the thyristor SCR for inhibiting the transmission of the fire signal. At the time of fire supervision, the rotary switch 16*a* is set to a desired. sensitivity position. When the detection operation of the thyristor SCR is started and the control section 7 determines fire, a directive signal of given voltage is applied to a charging circuit comprised of a capacitor C and a resistor Rg through a resistor Rs to actuate the thyristor SCR. As a result, an alarm indicating lamp is lit and a fire signal is transmitted to the central signal station 1 by returning a line current which is determined by a resistor Rf.

Although the forgoing embodiments are given with reference to a particular type smoke detector, the present invention is not limited to that type of smoke detector and the invention may be applied to a spot-type smoke detector in which a light emitting section and a light receiving section are provided within a box. The present invention is also applicable to a photoelectric switch generally used in the manufacturing line.

What is claimed is:

1. A smoke detector which comprises:

a light emitting section for radiating light pulses to a detection area with a predetermined repetition period;

a light receiving section disposed opposite said light emitting section with the detection area defined therebetween for receiving the light pulses transmitted through the detection area to thereby detect a change caused in the detection area, said light receiving section comprising:

means for producing a detection signal in response to a change in the light pulses in the detection area due to the existence of smoke in the detection area, means for producing a monitor signal for testing by a measuring apparatus which corresponds to the change in the light pulses, and means for changing the repetition period of the light pulses from said predetermined period to a shorter period when a measuring apparatus is connected to said means for producing said monitor signal.

2. A smoke detector according to claim 1, wherein said light receiving section further comprises means for maintaining the monitor signal at a given value during the period from emission of a light pulse to emission of a succeeding light pulse.

3. A smoke detector according to claim 1, which further comprises means for adjusting a level of the monitor signal.

4. A smoke detector which comprises:

a light emitting section for radiating light pulses to a detection area with a predetermined repetition period;

a light receiving section disposed opposite said light emitting section with the detection area defined therebetween for receiving the light pulses transmitted through the detection area to thereby detect a change caused in detection area; said light receiving section comprising means for producing a detection signal in response to a change in the light pulses in the detection area due to the existence of smoke in the area, sensitivity setting means for varying the photosensitivity of said light receiving section according to the distance from the light emitting section, means for inhibiting said detection signal when said sensitivity setting means is in an OFF condition, means for producing a monitor signal for testing by a measuring apparatus and corresponding to the change in the light pulses, and means for changing the repetition period of the light pulses from said predetermined period to a shorter period when a measuring apparatus is connected to said means for producing said monitor signal.

5. A smoke detector according to claim 4, wherein said light receiving section further comprises means for maintaining the monitor signal at a given value during the period of time from emission of a light pulse to emission of a succeeding pulse light.

6. A smoke detector according to claim 4, which further comprises means for adjusting the level of the monitor signal.

* * * * *